US011056029B1

(12) United States Patent
Wang

(10) Patent No.: US 11,056,029 B1
(45) Date of Patent: Jul. 6, 2021

(54) LED MODULE, DISPLAY AND CALIBRATION SYSTEM WITH TRACEABILITY

(71) Applicant: WEIDA HI-TECH CORPORATION LTD., Hsinchu (TW)

(72) Inventor: Jen-Chuan Wang, Hsinchu (TW)

(73) Assignee: WEIDA HI-TECH CORPORATION LTD., Hsinchu (TW)

( * ) Notice: Subject to any disclaimer, the term of this patent is extended or adjusted under 35 U.S.C. 154(b) by 0 days.

(21) Appl. No.: 16/737,282

(22) Filed: Jan. 8, 2020

(51) Int. Cl.
*G09G 3/00* (2006.01)
*G09G 3/32* (2016.01)

(52) U.S. Cl.
CPC ..... *G09G 3/006* (2013.01); *G09G 3/32* (2013.01); *G09G 2310/027* (2013.01); *G09G 2320/0693* (2013.01)

(58) Field of Classification Search
CPC .... G09G 3/006; G09G 3/32; G09G 2310/027; G09G 2320/0693
See application file for complete search history.

(56) References Cited

U.S. PATENT DOCUMENTS

2017/0124929 A1* 5/2017 Track ..... G09G 3/006
2020/0219439 A1* 7/2020 Wu ..... G09G 3/2003

FOREIGN PATENT DOCUMENTS

| | | | |
|---|---|---|---|
| CN | 101217022 | B | 6/2010 |
| CN | 103440844 | A | 12/2013 |
| CN | 104123900 | A | 10/2014 |
| CN | 104794555 | A | 7/2015 |
| CN | 102347984 | B | 1/2016 |
| CN | 105848345 | A | 8/2016 |
| TW | 201345311 | A | 11/2013 |

* cited by examiner

*Primary Examiner* — Kenneth B Lee, Jr.
(74) *Attorney, Agent, or Firm* — Muncy, Geissler, Olds & Lowe, P.C.

(57) ABSTRACT

A LED module applicable to a LED display system includes: an interface circuit, transmitting display data and a control signal between the LED display system and the LED module; a uniform standard conversion circuit, which is coupled to the interface circuit and computes the display data and a calibration parameter pre-stored in the uniform standard conversion circuit to generate and output grayscale data; a display memory storing and outputting the grayscale data; a constant current driving circuit, which is coupled to the display memory and outputs a constant current according to the grayscale data; and a LED lamp generating a light source according to the constant current to display an image.

9 Claims, 3 Drawing Sheets

LED MODULE, DISPLAY AND CALIBRATION SYSTEM WITH TRACEABILITY

BACKGROUND OF THE INVENTION

Field of the Invention

The invention relates to a light emitting diode (hereinafter referred to as LED) module, a display and a calibration system with traceability, and more particularly to a LED module having a non-volatile memory and pre-storing a calibration parameter of the LED module and a LED module traceability (e.g., a module number, a display system number, LED lamp production information, a used time and the like), a LED display system, a LED display and a calibration system.

Description of the Related Art

In a conventional LED module, because LED dies emit nonuniform lights, or driving circuits have nonuniform abilities, or packages have nonuniform optical properties, these factors cause nonuniform image display properties of light emitting spots of the LED module. So, after the conventional LED modules are combined into a large-scale display, the image display problem becomes more complicated. The production data of the LED module, such as the production data of the LED die, the test production data of the LED package, the production data of the driver IC, the production data of the LED circuit board and the like, do not have systematized integration and link. This leads to time-consuming, labor-consuming and money-consuming problems of after-sales maintenance. With the popularization of the small-pitch LED display and micro LED display, the required number of the LED also gets more and more. When the LED module fails and needs to be maintained, the more difficult problem arises.

So, the invention can overcome the above-mentioned problems so that each LED module possesses the consistent absolute brightness or color. With the existing latest technology, the traceability of the LED module is recorded in the non-volatile memory in a wired or wireless manner, record query and analysis are performed using the Internet of Things (IOT) and artificial intelligence (hereinafter referred to as AI) big data technology, and after-sales traceability certification of the LED module is performed to achieve the health tracking maintenance management.

BRIEF SUMMARY OF THE INVENTION

An objective of the invention is to make each LED module have consistent absolute brightness or color.

Another objective of the invention is to make each LED module perform record query and analysis according to Internet of Things (IOT) and AI data so as to predict the LED module, which tends to fail.

Still another objective of the invention is to make each LED module perform the analysis according to AI data to predict new calibration parameter.

The invention provides a LED module including: an interface circuit transmitting display data and a control signal between the LED module and a LED display system; a uniform standard conversion circuit, which is coupled to the interface circuit and computes the display data and a calibration parameter pre-stored in the uniform standard conversion circuit to generate and output grayscale data; a display memory storing grayscale data and outputting the grayscale data; a constant current driving circuit, which is coupled to the display memory and outputs a constant current according to the grayscale data; and a LED lamp generating a light source to display an image according to the constant current.

The invention provides a LED display system including: a LED module array composed of multiple LED modules, each of the LED modules including: an interface circuit transmitting display data and a control signal between the LED module and the LED display system; a uniform standard conversion circuit, which is coupled to the interface circuit and computes the display data and a calibration parameter pre-stored in the uniform standard conversion circuit to generate and output grayscale data; a display memory storing the grayscale data and outputting the grayscale data; a constant current driving circuit, which is coupled to the display memory and outputs a constant current according to the grayscale data; and a LED lamp generating a light source to display an image according to the constant current; and a LED display controller controlling the LED module array according to the display data and the control signal; wherein the LED display controller controls each of the LED modules to store a LED display system traceability, such as the number, production parameter, operation state and the like.

The invention provides a LED display and calibration system including: a LED display system having a LED module and generating an image; a calibration control module for storing a re-calibration first calibration parameter together with a LED module traceability into a non-volatile memory of the LED module; and an Internet of Things (IOT) control module uploading the first calibration parameter and the LED module traceability to an Internet of Things (IOT) cloud system.

DETAILED DESCRIPTION OF THE INVENTION

Figure 1:
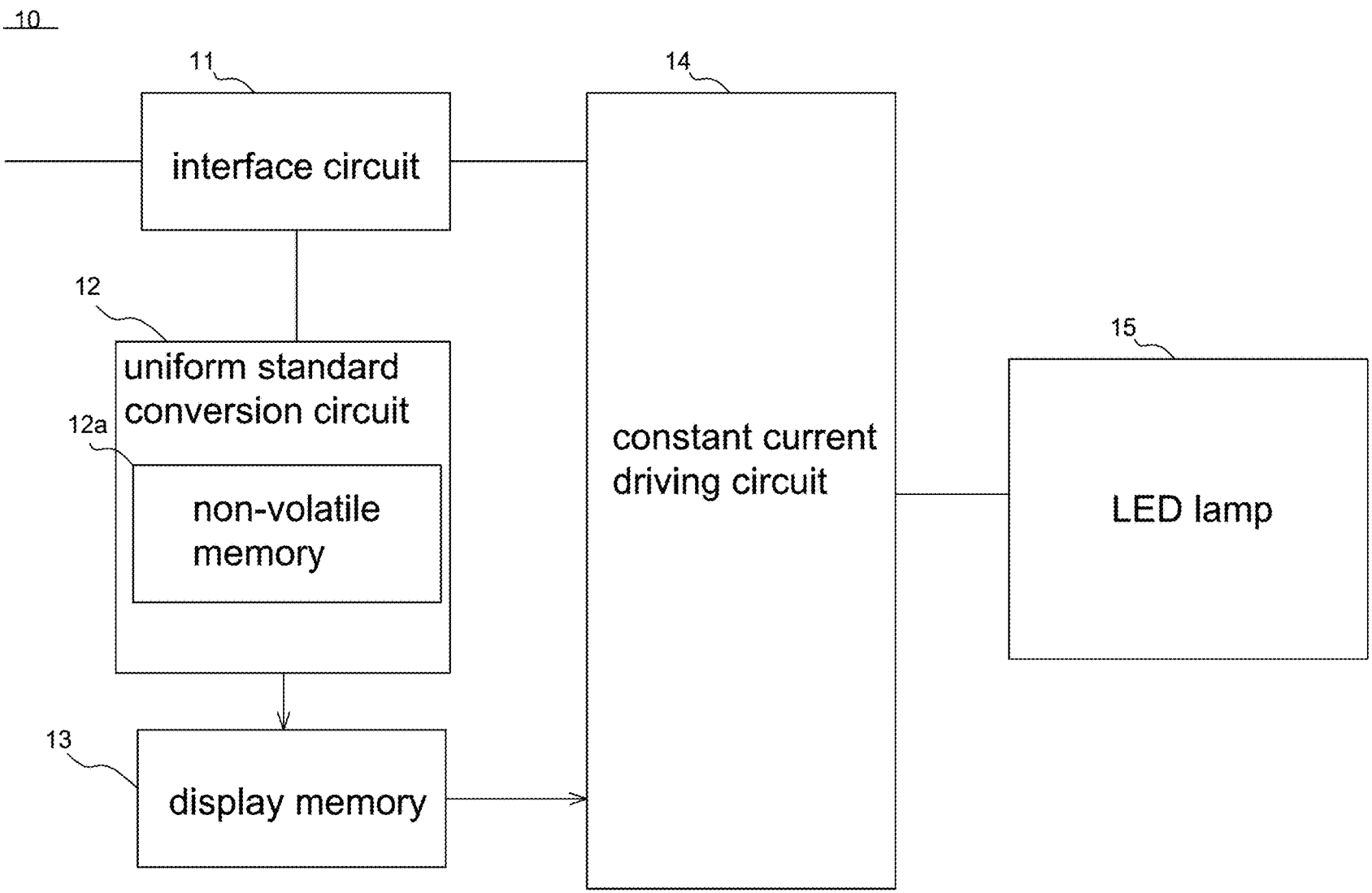
FIG. 1 is a schematic view showing a LED module of the invention.

FIG. 1 is a schematic view showing a LED module of the invention. Referring to FIG. 1, a LED module 10 includes an interface circuit 11, a uniform standard conversion circuit 12, a display memory 13, a constant current driving circuit 14 and a LED lamp 15.

The interface circuit 11 transmits display data and a control signal between the LED module 10 and a LED display system (not shown). The uniform standard conversion circuit 12 coupled to the interface circuit 11 receives the display data and computes the display data and a calibration parameter pre-stored in the uniform standard conversion circuit 12 to generate grayscale data, and outputs the grayscale data to the display memory 13. The display memory 13 stores the grayscale data and outputs the grayscale data to the constant current driving circuit 14. The constant current driving circuit 14 coupled to the display memory 13 and the LED lamp 15 outputs the constant current according to the grayscale data, so that the LED lamp 15 generates a light source according to the constant current to make the LED module 10 display an image.

Please note that the uniform standard conversion circuit 12 further includes a non-volatile memory 12*a* for pre-storing the calibration parameter corresponding to the LED module 10 or a LED module traceability. In one embodiment, the traceability may be implemented by the data including a module number, a display system number, LED lamp production information, a used time or the like.

In this embodiment, the uniform standard conversion circuit 12 receives the display data and computes the display data and the calibration parameter pre-stored in the uniform standard conversion circuit 12 to generate grayscale data, and outputs the grayscale data to the display memory 13. Furthermore, the constant current outputted from the constant current driving circuit 14 may be controlled based on the X-axis or Y-axis of the LED lamp 15. The constant current driving circuit 14 may be implemented by a pulse width modulation (PWM) circuit. Because the non-volatile memory 12*a* of the invention stores the calibration parameter when the LED module 10 is shipped out and the calibration parameter is generated by an automatic calibration method, which is based on the absolute brightness or color and is substantially the point-to-point calibration method, the image displayed according to the LED lamp can be kept at the consistent absolute brightness or color. In another embodiment, each set of LED lamps 15 include a red (R) lamp, a green (G) lamp and a blue (B) lamp.

Figure 2:
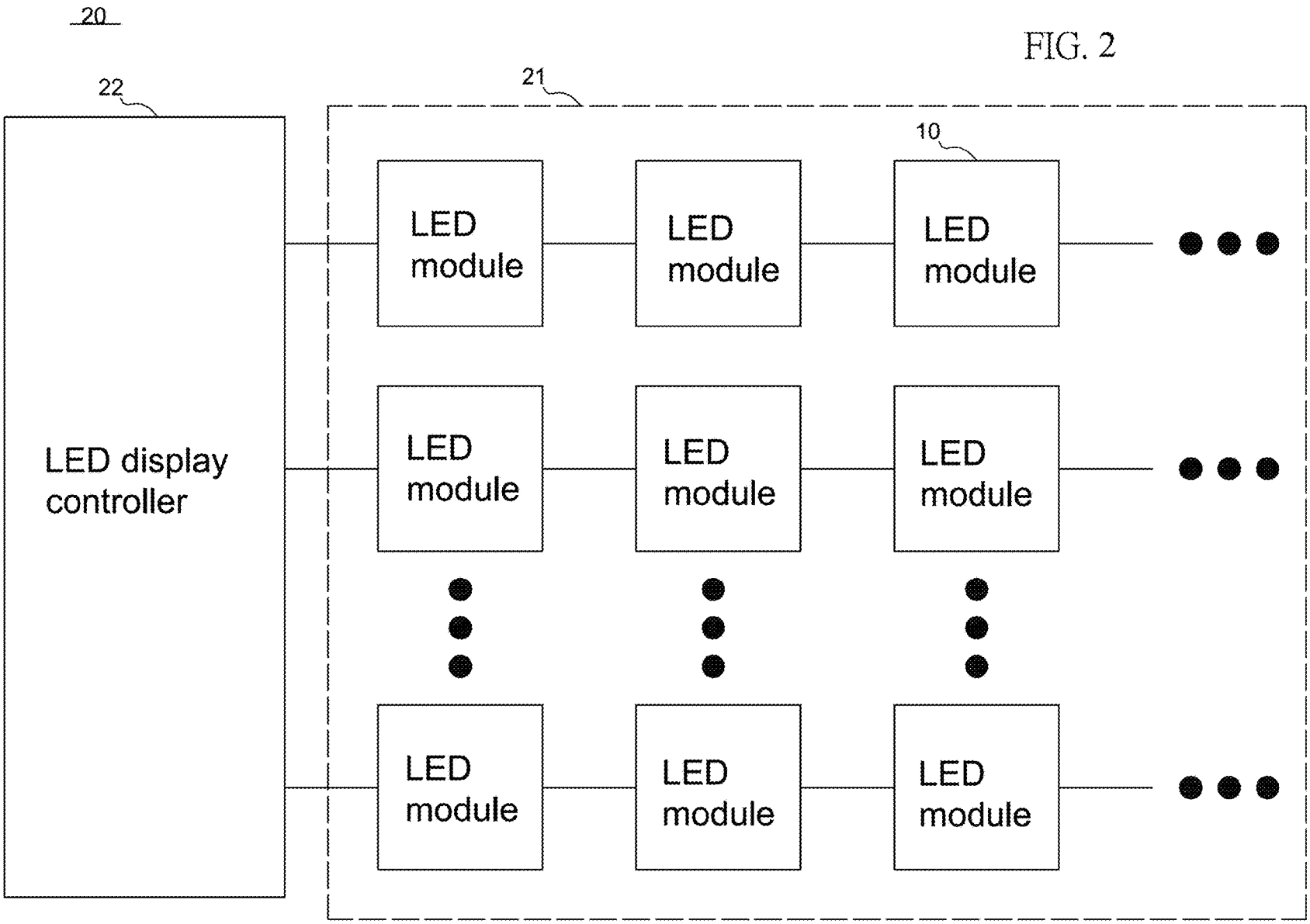
FIG. 2 is a schematic view showing the LED module of the invention applied to a LED display system.

Please note that the grayscale data stored in the display memory 13 of this embodiment is generated by computing the display data and the calibration parameter pre-stored in the uniform standard conversion circuit 12. FIG. 2 is a schematic view showing the LED module of the invention applied to the LED display system. Referring to FIGS. 2 and 1, a LED display system 20 includes a LED module array 21 and a LED display controller 22.

Please note that the LED module array 21 is composed of multiple LED modules 10, and the multiple LED modules 10 are serially connected and horizontally combined into the LED module array 21 in this embodiment. Each LED module 10 includes the interface circuit 11, the uniform standard conversion circuit 12, the display memory 13, the constant current driving circuit 14 and the LED lamp 15. The operation principle thereof has been previously mentioned, and detailed descriptions thereof will be omitted here.

The LED display controller 22 controls the LED module array 21 according to the display data and the control signal. The display data and the control signal come from an Internet of Things (IOT) cloud system (not shown) or a LED display calibration system (not shown). The LED display controller 22 is in charge of transmitting the display data and the control signal to each LED module 10 in the LED module array 21, or transmitting the control signal to read out the LED module traceability of the non-volatile memory 12*a* in the LED module 10, and transmitting the LED module traceability to the LED display calibration system or the IOT cloud system.

The uniform standard conversion circuit 12 of the invention computes the display data and the calibration parameter pre-stored in the uniform standard conversion circuit 12 to generate and output grayscale data. Please note that this computation is still performed in each LED module 10, so the loading of the LED display controller 22 can be decreased.

Figure 3:
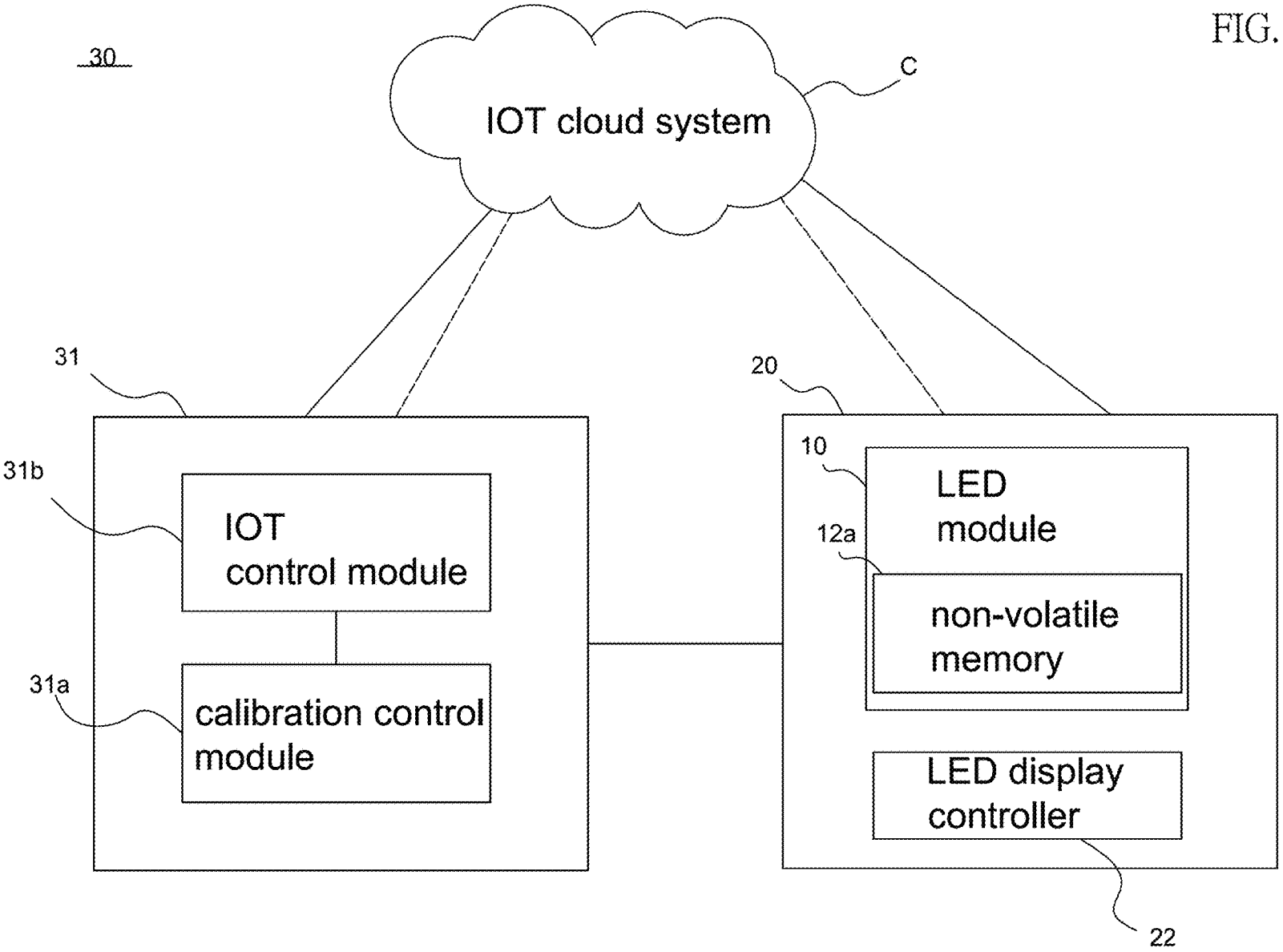
FIG. 3 is a schematic view showing the LED module of the invention applied to a calibration system of the LED display.

FIG. 3 is a schematic view showing the LED module of the invention applied to a calibration system of the LED display. Referring to FIG. 3, a LED display and calibration system 30 includes the LED display system 20 and a LED calibration system 31.

As previously mentioned, the LED display system 20 has multiple LED modules 10 combined into the LED module array 21 to generate the image, wherein the non-volatile memory 12*a* in each LED module 10 pre-stores the calibration parameter or the LED module traceability corresponding to each LED module 10.

The LED calibration system 31 includes: a calibration control module 31*a* for storing the re-calibration parameter into the non-volatile memory 12*a* corresponding the LED module 10; an Internet of Things (IOT) control module 31*b* for uploading the re-calibration parameter and the LED module traceability to an IOT cloud system C. Please note that when the aging of the LED module 10 occurs or the ambient LED module 10 is replaced with a new one, the LED calibration system 31 needs to re-calibrate the LED module 10 to generate a re-calibration parameter to be transmitted to the corresponding LED module 10.

In one embodiment, the IOT cloud system C generates the control signal transmitted to the LED module 10, and the LED module 10 performs a self detection process according to the control signal, wherein the control signal controls the constant current outputted from the constant current driving circuit 14 to detect whether the LED lamp 15 fails or not. If the LED lamp 15 fails, the constant current driving circuit 14 obtains the corresponding coordinate data of the failed LED lamp 15, and transmits the coordinate data to the interface circuit 11. The interface circuit 11 stores the coordinate data into the non-volatile memory 12*a*, or the interface circuit 11 transmits the coordinate data to the display system 20. Then, the display system 20 transmits the coordinate data to the LED calibration system 31, or the display system 20 directly transmits the coordinate data back to the IOT cloud system C.

Please note that the conventional LED display calibration method is not linked to the IOT cloud system. However, with the gradual popularization of the small-pitch LED display system and the micro LED display system, the required number of the LED modules is getting more and more. When the LED module tends to fail or has aged and needs to be re-calibrated, it is very important to use the IOT cloud system and AI to manage the LED display system and the LED module.

In addition, the LED module traceability stored in the non-volatile memory 12*a* may be read out by two methods. In the first method, the LED module traceability is obtained by the calibration control module 31*a* through a conventional receiving card. The second method uses the IOT cloud system C through the IOT control module 31*b* so that the IOT control module 31*b* reads out the LED module traceability stored in the non-volatile memory 12*a* in a wired or wireless manner. After the IOT cloud system C has obtained the LED module traceability, and the AI data analysis is performed to predict which LED module 10 will fail, the LED module 10 before getting failed can be maintained or replaced in advance. The current usage condition of the aged LED module may also be obtained according to the used data record of the non-volatile memory 12*a*, and the analysis can be performed through the AI data computation to obtain the new calibration parameter. The IOT cloud system C can directly transmit the new calibration parameter to the non-volatile memory 12*a* in the aged LED module 10 in the LED display system. Alternatively, the new calibration parameter can be transmitted through the IOT control module 31*b*, and the calibration control module 31*a* can store the new calibration parameter into the non-volatile memory 12*a* in the aged LED module 10 in the wired method. The display data and the new calibration parameter stored in the uniform standard conversion circuit 12 are computed to generate new grayscale data, so that the LED module 10 and its adjacent LED module 10 can be held to have the consistent absolute brightness or color without the conventional calibration on the overall LED display system 20. Thus, it is possible to avoid the time-consuming, labor-consuming and cost-consuming condition, and the point-to-point calibration can be further achieved.

Please note that in the used period of the LED module 10, the LED display controller 22 controls the non-volatile memory 12*a* in each LED module 10 to store the LED display system traceability of the LED display system 20, and the non-volatile memory 12*a* records the usage condition of the LED module 10 to function as the data for the AI analysis of the IOT cloud system C. This method can effectively perform the after-sales traceability certification of the LED module 10, and thus achieve the health tracking maintenance management. Each LED module 10 may also have a QR code, through which the IOT cloud system C can be directly linked. According to this link, it is possible to obtain the production traceability of each LED module 10, which can be used in conjunction with the non-volatile memory 12*a* in the LED module 10. That is, when the non-volatile memory 12*a* in the LED module 10 fails, it is still possible to link to the IOT cloud system C through the QR code to look up the traceability of the LED module 10 and perform the AI data analysis and maintenance.

The work mode of the LED module 10 of the invention may be divided into three stages including a factory fabrication stage, a customer use stage and a failure maintenance stage. In the factory fabrication stage, the LED module 10 is basically present alone in the form of a module, and the data transmission to and from the non-volatile memory 12*a* in the LED module 10 is performed directly through the fabrication tool, so that the calibration parameter and the traceability of the LED module 10 are written or read.

In the customer use stage, the LED modules 10 are assembled into the LED display system 20, as shown in FIG. 2. The work mode in this stage needs to write the LED display system traceability into the LED module 10 in each LED module array 21 through the LED display controller 22, so that the non-volatile memory 12*a* stores the LED display system traceability and the usage condition of the LED module 10. In this stage, the user can write (or read) the LED display system traceability and the usage condition of the LED module 10 into (or from) the non-volatile memory 12*a* through the LED display controller 22 to serve as the data for the AI data analysis and the health trace manage. If the usage condition of the LED module 10 is found to become abnormal, then the corresponding LED module 10 can be found according to the LED display system traceability and the LED module traceability, and the LED module traceability of the LED module 10 can be queried and analyzed.

The failure maintenance stage may be classified into two conditions. The first condition is caused by aging to make the module display the nonuniform image, and the second condition is that the failed module cannot normally display the image. If the first condition occurs, then the new calibration parameter can be predicted according to the usage condition and the LED module traceability of each LED module 10 by way of AI data analysis. This condition does not need the on site operation, and can be completed by the communication between the wired or wireless manner and the LED display controller 22. However, if the second condition occurs, then the failed LED module 10 on the LED display system 20 cannot normally display the image, and the new LED module 10 needs to be replaced on site. Then, the usage conditions and the LED module traceabilities of the adjacent old modules are analyzed and computed to generate the new calibration parameter by way of AI data analysis, so that the new LED module 10 and its adjacent old modules have the consistent absolute brightness or color, and the LED calibration system 31 further performs the verification. The damaged LED module 10 is sent back to the factory for maintenance. It is also possible to assist the diagnosis and maintenance according to the LED module traceability in the non-volatile memory 12*a* in the LED module 10, and to feed the diagnosis result back to the AI database to serve as the basis for continuous improvements.

In summary, the invention discloses the architecture of performing calibration based on the LED module, wherein the calibration parameter is generated according to the automatic calibration method of the absolute brightness or color, and the calibration parameter and the traceability are stored in the non-volatile memory before the LED module is shipped out. In the use period of the LED module, the LED display controller writes the display number into the module and records the usage condition and the like into the non-volatile memory, wherein the data may also be used to perform the AI cloud data computation. This method can effectively perform the after-sales traceability certification of the module, and thus achieve the health tracking maintenance management. The uniform standard transformation operation is performed according to the calibration parameter in the LED module and the inputted display image data, so that the LED modules possess the consistent absolute brightness or color and the point-to-point calibration can be achieved.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A light emitting diode (LED) module applicable to a LED display system, the LED module comprising:

an interface circuit transmitting display data and a control signal between the LED module and the LED display system;

a uniform standard conversion circuit, which is coupled to the interface circuit, and computes the display data and a calibration parameter pre-stored in the uniform standard conversion circuit to generate and output grayscale data;

a display memory storing and outputting the grayscale data;

a constant current driving circuit, which is coupled to the display memory, and outputs a constant current according to the grayscale data; and a LED lamp generating a light source to display an image according to the constant current; wherein, the uniform standard conversion circuit comprises a non-volatile memory for storing the calibration parameter corresponding to the LED module or a LED module traceability; and the LED module performs a self detection process according to the control signal, and the control signal controls the constant current driving circuit to output the constant current to detect whether the LED lamp fails; the constant current driving circuit obtains corresponding coordinate data of the failed LED lamp, and transmits the coordinate data to the interface circuit, wherein the interface circuit stores the coordinate data into the non-volatile memory, or the interface circuit transmits the coordinate data to the display system.

2. A light emitting diode (LED) display system, comprising:

a LED module array composed of multiple LED modules, wherein each of the LED modules comprises:

an interface circuit transmitting display data and a control signal between the LED module and the LED display system;

a uniform standard conversion circuit, which is coupled to the interface circuit, and computes the display data and a calibration parameter pre-stored in the uniform standard conversion circuit to generate and output grayscale data;

a display memory storing and outputting the grayscale data;

a constant current driving circuit, which is coupled to the display memory, and outputs a constant current according to the grayscale data; and a LED lamp generating a light source according to the constant current to display an image; and a LED display controller controlling the LED module array according to the display data and the control signal;

wherein the LED display controller controls each of the LED modules to store a LED display system traceability.

3. The LED display system according to claim 2, wherein the uniform standard conversion circuit comprises:

a non-volatile memory for pre-storing the calibration parameter corresponding to the LED module, a LED module traceability, or the LED display system traceability corresponding to the LED display system.

4. The LED display system according to claim 3, wherein the LED module performs a self detection process according to the control signal, and the control signal controls the constant current driving circuit to output the constant current to detect whether the LED lamp fails; the constant current driving circuit obtains corresponding coordinate data of the failed LED lamp, and transmits the coordinate data to the interface circuit, wherein the interface circuit stores the coordinate data into the non-volatile memory, or the interface circuit transmits the coordinate data to the display system.

5. The LED display system according to claim 4, wherein the LED display controller also transmits data stored in the non-volatile memory to a LED display calibration system or an Internet of Things (IOT) cloud system.

6. A light emitting diode (LED) display and calibration system, comprising:

a LED display system having a LED module and generating an image;

a calibration control module for storing a first calibration parameter into a non-volatile memory of the LED module; and an Internet of Things (IOT) control module uploading the first calibration parameter and a LED module traceability to an Internet of Things (IOT) cloud system;

a LED module array composed of multiple ones of the LED modules, each of the LED modules comprising:

an interface circuit transmitting display data and a control signal between the LED module and the LED display system;

a uniform standard conversion circuit, which is coupled to the interface circuit, and computes the display data and a second calibration parameter or the first calibration parameter pre-stored in the uniform standard conversion circuit to generate and output grayscale data;

a display memory storing and outputting the grayscale data;

a constant current driving circuit, which is coupled to the display memory, and outputs a constant current according to the grayscale data; and a LED lamp generating a light source according to the constant current to display the image; and a LED display controller controlling the LED module array according to the display data and the control signal;

wherein the LED display controller controls each of the LED modules to store a LED display system traceability.

7. The LED display and calibration system according to claim 6, wherein the uniform standard conversion circuit has the non-volatile memory, for pre-storing the second calibration parameter or the first calibration parameter corresponding to the LED module, the LED module traceability, or the LED display system traceability corresponding to the LED display system.

8. The LED display and calibration system according to claim 7, wherein the LED module performs a self detection process according to the control signal, and the control signal controls the constant current driving circuit to detect whether the LED lamp fails; the constant current driving circuit obtains corresponding coordinate data of the failed LED lamp, and transmits the coordinate data to the interface circuit, wherein the interface circuit stores the coordinate data into the non-volatile memory, or the interface circuit transmits the coordinate data to the display system.

9. The LED display and calibration system according to claim 8, wherein the LED module has a QR code, and the LED module can be directly linked to the Internet of Things (IOT) cloud system or linked to the LED calibration system through the QR code to perform AI data analysis and LED module maintenance.

* * * * *